US006692350B1

(12) United States Patent
Moy

(10) Patent No.: US 6,692,350 B1
(45) Date of Patent: Feb. 17, 2004

(54) ERGONOMICALLY ACCESSIBLE AIRFLOW CONTROL MECHANISM FOR A REGISTER

(76) Inventor: Gerard E. Moy, 1608 Danube La., Plano, TX (US) 75075

( * ) Notice: Subject to any disclaimer, the term of this patent is extended or adjusted under 35 U.S.C. 154(b) by 0 days.

(21) Appl. No.: 10/356,835

(22) Filed: Feb. 3, 2003

(51) Int. Cl.[7] ..... F24F 13/075; F24F 13/15
(52) U.S. Cl. ..... 454/299; 454/325
(58) Field of Search ..... 454/290, 292, 454/299, 318, 325, 326

(56) References Cited

U.S. PATENT DOCUMENTS

| | | | | |
|---|---|---|---|---|
| 2,761,371 A | | 9/1956 | Parrish | |
| 2,766,676 A | * | 10/1956 | Babcock | 454/288 |
| 2,858,759 A | * | 11/1958 | Kice et al. | 454/266 |
| 2,910,927 A | * | 11/1959 | Barnwell | 454/307 |
| 3,299,798 A | * | 1/1967 | Nabben | 454/259 |
| 3,500,739 A | | 3/1970 | Dry | |
| 3,682,085 A | | 8/1972 | Dennis | |
| 3,720,154 A | | 3/1973 | Biggi | |
| 3,938,430 A | | 2/1976 | Koppang | |
| 4,020,889 A | | 5/1977 | Karoll | |
| 4,876,951 A | | 10/1989 | Vork | |
| 4,907,500 A | | 3/1990 | Brown | |
| 5,989,119 A | * | 11/1999 | Raisanen | 454/239 |
| 6,435,962 B1 | | 8/2002 | Herron et al. | |

FOREIGN PATENT DOCUMENTS

| | | | |
|---|---|---|---|
| CH | 165436 | * 11/1933 | 454/325 |
| SE | 142 485 | * 10/1953 | 454/325 |

* cited by examiner

*Primary Examiner*—Harold Joyce
(74) *Attorney, Agent, or Firm*—Gerard E. Moy

(57) ABSTRACT

A register containing an airflow control mechanism is disclosed whereby the control mechanism is easily accessed by a user when mounted on the ceiling of a room. The ergonomically accessible airflow control mechanism comprises a pull chain arrangement means which dangles from the register and is adaptable to any height. The pull chain arrangement is interconnected to a plurality of louvers rotatably mounted above the face plate of the register via a connecting means which transfers the vertical pulling action of a user on the pull chain arrangement to rotational movement of the louvers between an open and closed position. The connecting means as well as the rotatable louvers are mounted on the upper side of a face plate and hidden from view when in the operative position thus providing an inconspicuous, aesthetically pleasing finish to a room's decor.

7 Claims, 5 Drawing Sheets

ERGONOMICALLY ACCESSIBLE AIRFLOW CONTROL MECHANISM FOR A REGISTER

CROSS-REFERENCE TO RELATED APPLICATIONS

Not applicable.

FIELD OF INVENTION

This apparatus relates to registers or dampers which have louvers for the control of air flow into a room, and more particularly, to an ergonomically accessible air flow control mechanism wherein a plurality of louvers' control access point is adaptable to any predetermined distance below the face plate of the register for ease of manipulation of the amount and direction of the air flow through the register.

BACKGROUND OF THE INVENTION

Many of today's homes, as well as business and industrial buildings utilize climate control systems in which the air ducts terminating into a room or other enclosure is mounted on the ceiling thereof. This is largely due to the simplified design of climate control systems afforded by the routing of air ducts through attic recesses which have space available for placement therein. Air vents or Registers are typically mounted at the terminating portion of the air duct and are oriented generally flush with the plane of the ceiling in order to provide an aesthetically pleasing appearance as well as to provide a means to control the amount of airflow and to direct the airflow so that the conditioned air is evenly dispersed throughout the room. This means to control the airflow's quantity and direction is accomplished via louvers which are rotatably mounted on the register's housing. A lever or other control mechanism is provided at the bottom portion of the register so that a user may manually manipulate the rotational position of the louvers and thus control the direction and amount of airflow through the register. Nevertheless, because the manually operated control mechanism is mounted in close proximity to the register and the register is mounted generally flush with the ceiling, most users cannot easily reach the manually operated control mechanism without the aid of a stepstool, ladder, or the like. Even worse, if a ladder or other device is not readily available, the user may attempt to reach the control mechanism using a chair or other non-standard device, which could be potentially dangerous. Nevertheless, because the control mechanism is ergonomically inaccessible, many users opt to not bother adjusting the control mechanism in spite any thermal discomfort they may feel or energy savings they could effect by closing the control mechanism when the room is not in use. Even more importantly, many residences or commercial building structures have rooms that are used sparingly. Examples of such rooms include guest bedrooms, unused offices, storage rooms, or the like which although used occasionally, mostly remain vacant. To not turn off the airflow to these rooms during vacant periods is a needless waste of energy. Throughout the remainder of this document, registers, air vents, and dampers will be hereinafter referred to as registers.

Examples of several devices that provide for a means of manual adjustment of the amount and direction of airflow through the register are U.S. Pat. No. 3,500,739 to Dry, U.S. Pat. No. 3,682,085 to Dennis, U.S. Pat. No. 3,720,154 to Biggi, U.S. Pat. No. 3,938,430 to Koppang, U.S. Pat. No. 4,876,951 to Vork, U.S. Pat No. 4,907,500 to Brown, and U.S. Pat. No. 6,435,962 to Herron et al. Nevertheless, all of these designs suffer in that the manually control mechanism is positioned in close proximity to the register. Therefore, if the register is mounted on the surface of a ceiling of a room, a user must initially find a means of reaching the control mechanism before control of the airflow through the register may be realized.

What is needed is a manually operated control mechanism for the control of louvers rotatably connected to a register which is ergonomically accessible to any user. The control mechanism should be easily adaptable for use on ceilings of any height. In addition, the control mechanism should be adaptable to any type of register which is mounted on the ceiling of any room including bedrooms, offices, or the like.

SUMMARY OF INVENTION AND OBJECTIVES

The present invention provides a solution to these needs via a register having an ergonomically accessible airflow control mechanism for control of the louvers of a register mounted on the ceiling of a room. The airflow control mechanism includes a pull chain arrangement means which dangles from the surface of the face plate and is easily adaptable to hang any distance therebelow for easy access by a user. Therefore, the louvers may be easily manipulated without the need for any tools such as ladders or louver adjustment devices to extend the user's effective reaching capability.

One aspect of the present invention is the increased energy saving capability afforded through the use thereof. All prior art teachings disposed the airflow control mechanism in close proximity to the register's face plate. The ramifications of these earlier types of designs required the user to climb on objects such as ladders or employ the use of specialized tools to reach the control mechanism. Because the control system was not ergonomically accessible, many users opted to not bother with the control mechanism in spite of the costs incurred via cooling or heating an unused room unnecessarily. The present invention solves these problems via a control mechanism which is easily accessible and controllable.

Another aspect of the present invention is the increased comfort level attainable thereby. The normal airflow patterns through an entire building can be disrupted due to a closed door which inherently obstructs normal airflow from room to room. The present invention provides an easy means to adjust air flow entering a room to counteract the effect of a closed door on the air flow patterns of a normally designed climate control system. In addition, the present invention allows individuals who are "hot natured" or "cold natured" to have the ability to more precisely tailor the temperature of a particular room to suit his or her own tastes.

It is therefore a primary object of the present invention to provide an ergonomically accessible airflow control mechanism for a register which is the control mechanism is easily accessible by a user for the control of amount and direction of airflow through a register.

A further object of the present invention is to provide an ergonomically accessible air flow control mechanism for a register that is highly versatile for use on any height of room, whereas the pull chain arrangement means is easily adaptable to dangle any vertical length below the register's face plate.

A further object of the present invention is to provide an ergonomically accessible airflow control mechanism for a register that is inexpensive to produce as well as inexpensive to operate. Further, the present invention will effect energy savings in that climatized airflow to unused or rarely used rooms can be turned off or turned down in order to reduce unnecessary cooling or heating thereof.

A further object of the present invention is to provide an ergonomically accessible air flow control mechanism for a register that is inconspicuous and aesthetically pleasing finish to a room's decor; the only visible portion of the control mechanism being a pull chain arrangement means which dangles from the register.

A further object of the present invention is to provide an ergonomically accessible airflow control mechanism for a register that is adaptable to any commonly accepted size and type of register which contains rotatable louvers for the control of airflow therethrough. Moreover, any register design could benefit from the teachings of this invention by creating a more easily accessible control means for the control of airflow therethrough.

These and other objects of the present invention will become readily apparent to those familiar with the construction and use of registers and will become apparent in the following portions of the specification, wherein the detailed description is for the purpose of fully disclosing preferred embodiments of the invention without placing limitations thereon.

BRIEF DESCRIPTION OF THE DRAWINGS

For a more complete understanding of the present invention, and the advantages thereof, reference is now made to the following descriptions taken in conjunction with the accompanying drawings. In all of the following drawings, it is to be understood that the lengths of all pull chain segments is relative and for illustrative purposes only; the pull chain length is adaptable to any length to suit any application on any height of room.

DETAILED DESCRIPTION OF THE PREFERRED EMBODIMENTS

Figure 1:
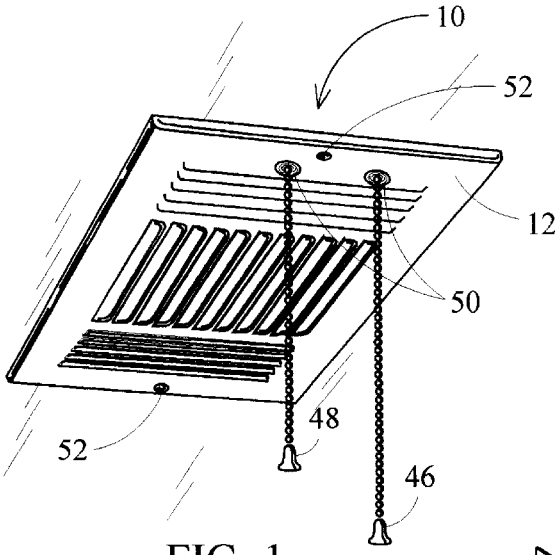
FIG. 1 is a perspective view of one preferred embodiment in operative engagement on the ceiling of a room. The end of first pull chain 46 which hangs lower than the corresponding end of second pull chain 48 provides visual indication that the louvers are in the open position.
Figure 2:
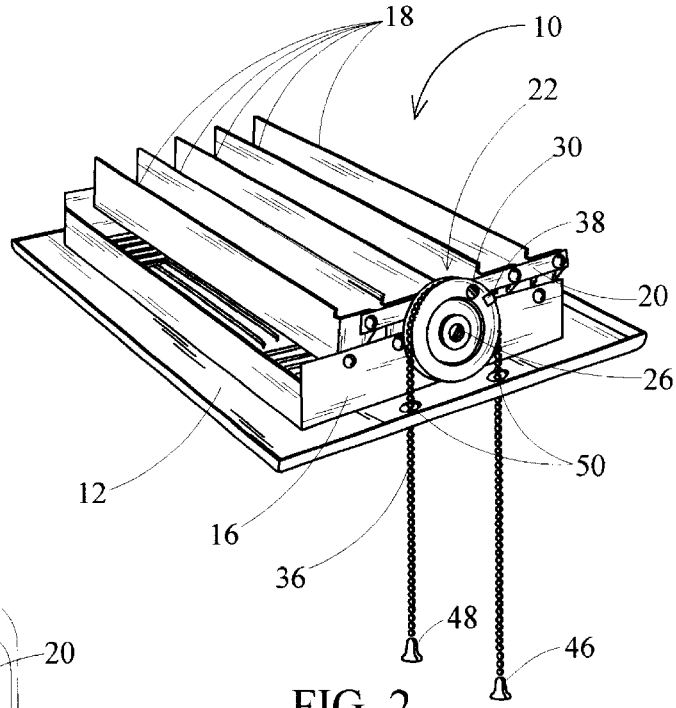
FIG. 2 is a perspective view of the embodiment of FIG. 1 showing the arrangement of the louvers rotatably connected to the rectangular frame disposed above the face plate. The plurality of louvers are in the open position.

As shown in FIGS. 1 through 6, a register embodying a preferred embodiment of a device according to the instant invention is designated generally by reference numeral 10. The register 10 has a face plate 12 for dispersion of air entering the room from the air duct (not shown) and has a rectangular frame 16 attached to the rearward surface thereof The register 10 also has a plurality of louvers 18 rotatably attached to the rectangular frame 16 which operate to control the amount and direction of the airflow through the register 10. A connecting rod 20 is interconnected via a rotatable connection to each of the plurality of louvers 18 which causes all rotatable louvers 18 to rotate simultaneously when the connecting rod 20 is moved in an arcuate fashion. The face plate 12, rectangular frame 16, rotatable louvers 18, and connecting rod 20 is of conventional design and is well known in the art. A pull chain louver adjustment mechanism 22 embodying the present invention is rotatably attached to the connecting rod 20 and operates to rotate the louvers 18 to the desired position in a manner to be described herein.

Figure 3:
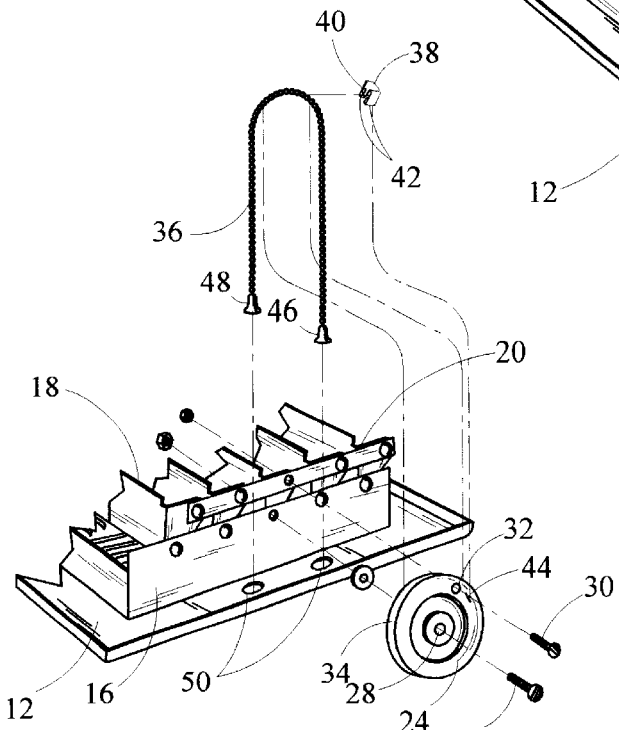
FIG. 3 is a partial perspective exploded view of the embodiment of FIG. 1 showing the ergonomically accessible airflow control mechanism as it is attached to the register.
Figure 4:
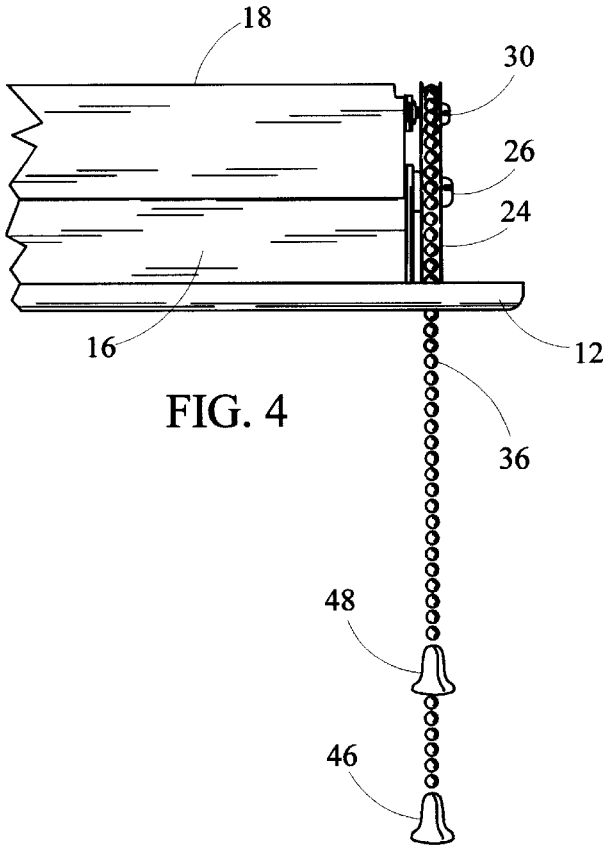
FIG. 4 is a partial side elevational view of the embodiment of FIG. 1 depicting the slim profile of the ergonomically accessible airflow control mechanism when attached to the register.

As shown in FIG. 3, a pulley 24 embodying the present invention is generally circular in shape and is rotatably mounted to the rectangular frame 16 via an axis bolt 26 that extends through an axis hole 28 in the pulley 24. Also, the pulley 24 is interconnected to the connecting rod 20 via a pintle bolt 30 which extends though a pintle hole 32 formed at a predetermined distance from the pulley's axis. The distance between the axis bolt 26 and the pintle bolt 30 as well as the angular orientation thereof is chosen such that the angular rotation of the pulley 24 causes the pintle bolt to swing in an arc substantially similar to the arcuate path of the connecting rod 20 throughout the rotatable louver assembly's range of motion. The pulley 24 has a slot 34 formed around its entire periphery which is dimensioned to accept a section of pull chain 36 therein. A chain holder 38 has a snap fit for one link section of the pull chain 36 thereby providing means of transferring tensional forces of the pull chain 36 to rotational movement of the pulley 24. A chain holder 38 constructed from resilient metal or the like has a snap-in tab 40 to replaceably secure the chain thereto and two mounting tabs 42 facing inward which fit into chain holder slots 44 on the side of the pulley 24. Moreover, the chain holder 38 is replaceably secured on the pulley 24 at a position in which the pull chain will always be in contact with the pulley throughout the available rotational range of the rotatable louvers 18. Alternatively, a sprocket like structure (not shown) may be employed in which indentations are formed within the slot specifically dimensioned to engage each bead of the pull chain made of a section of chain-of-beads in order to transfer the tensional forces from the pull chain to the rotational motion of the pulley or sprocket like structure would be a valid substitute. In its operable orientation, the pull chain 36 having a first pull chain end 46 and a second pull chain end 48 defining user control access points are allowed to dangle from the pulley 24 and extend through holes 50 in the face plate 12.

Alternatively, grommets (not shown) which may be constructed of hard rubber, nylon, or the like may be added to the holes 50 in order to enhance the present invention's aesthetic appeal. In addition, the pull chain may be made from a section of a chain-of-beads, string, or any flexible cable that possesses sufficient tensile strength under normal handling conditions and whose length is easily adaptable to any user's reaching ability. The axis bolt 26, and pintle bolt 30 described herein is a bolt however it is well known in the art that any pin which provides sufficient structural integrity and allows the pulley to rotate upon its axis would be a valid substitute. The chain holder in the aforementioned example was formed from a flat piece of resilient metal however it is well known in the art that the pull chain may be secured to the pulley using other means; an example of such including a section of wire which is bent at one end to form a loop, wherein the loop engages at least one section of the pull chain and the other end of the wire is inserted into a hole in the pulley for replaceable securement of one section of the pull chain to the pulley (not shown). The pulley in the aforementioned embodiment was made from thermoset polyurethane resin however the pulley may be made from any material which would be able to withstand temperature variations inherent in an air duct register application as well as physical forces placed upon it in normal handling conditions. Examples of such materials include nylon, plastic, pot metal, or the like. As shown in FIG. 1, a register with ergonomically accessible adjustment mechanism 10 is generally shown in operative engagement mounted on the ceiling of a room using two screws 52. This design is very advantageous in that the length of both ends of the pull chain assembly is easily adaptable to any length for use on any height of any ceiling.

Figure 5:
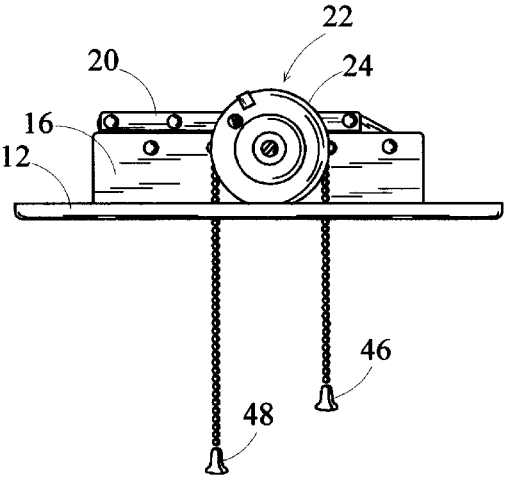
FIG. 5 is a side view of the embodiment of FIG. 1 showing the rotatable louvers in the closed position.
Figure 6:
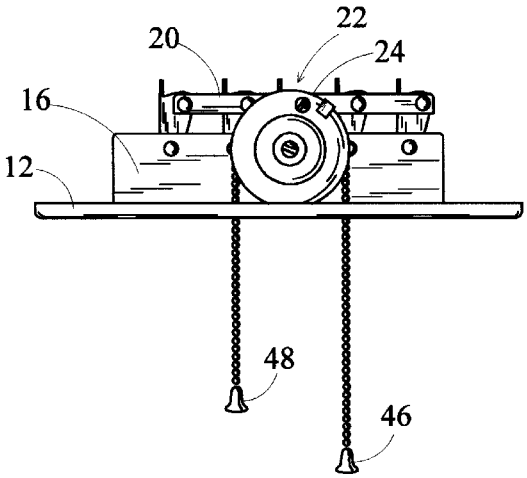
FIG. 6 is a side view of the embodiment of FIG. 1 showing the rotatable louvers in the open position.

FIGS. 5 and 6 depict the operation of the register having an ergonomically accessible airflow control mechanism. Initially in FIG. 5 the louvers are in a closed position and no airflow is allowed through the register 10. A user will pull on the first pull chain end 46 thus causing the pulley 18 to rotate in a clockwise direction. As a result, the louvers will rotate to an open position as shown in FIG. 6 and airflow is allowed to flow freely through the register. When the user desires to close the louvers again, the second pull chain end 48 is pulled and the louvers revert to the closed position as shown in FIG. 5. Alternatively, the user may only partially open the louvers by stopping the pulling operation when the desired orientation of the louvers has been obtained. This operation has many advantages over the prior art in that the user no longer has to stretch or climb on objects in order to control air flow through a register mounted on a ceiling; therefore energy savings as well as personal comfort has been enhanced via an easily accessible control mechanism configured therein.

Figure 7:
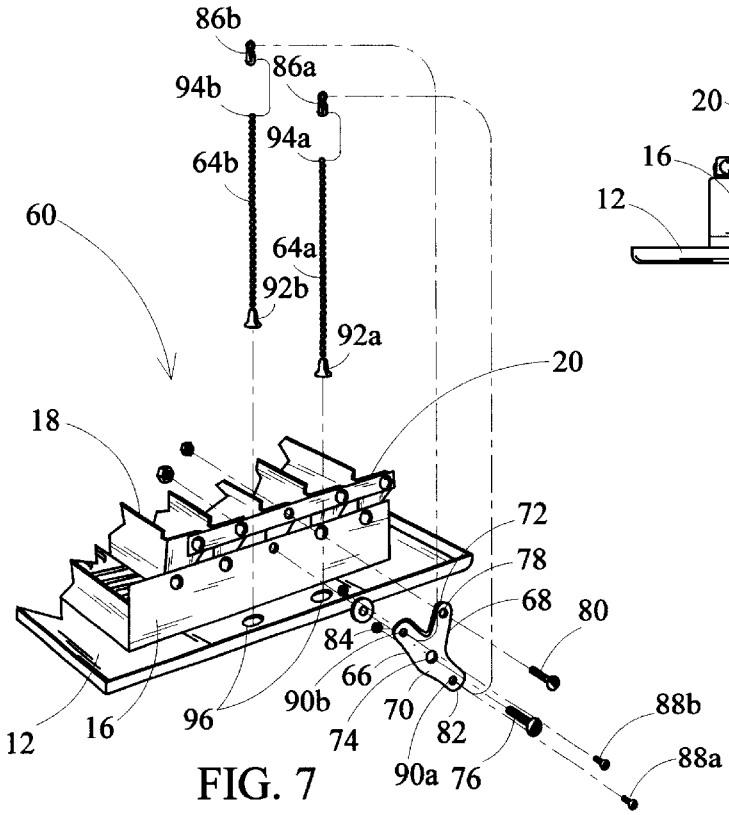
FIG. 7 is a partial perspective exploded view of an alternate embodiment of the present invention showing the ergonomically accessible airflow control mechanism as it is attached to the register.

An alternative embodiment 60 of the present invention contemplates a register having an ergonomically accessible airflow control mechanism which uses a lever bracket 62 to control the orientation of the louvers 18. The face plate 12, rectangular frame 16, rotatable louvers 18, and connecting rod 20 are similar in design and function to the register 10 of FIGS. 1–6. The embodiment of FIGS. 7 through 9 differ in that a lever bracket 62 is used in order to transfer the linear motion of a pair of pull chain segments (64*a* and 64*b*) to arcuate motion of the connecting rod 20 and thus the rotational orientation of the louvers 18.

The lever bracket 62 embodying the present invention comprises a rocker arm portion 66 and a coupling portion 68 integrally formed from one piece. The coupling portion 68 consists of an elongate section of material defining a proximal end 70 and a distal end 72. The proximal end 70 has an axis hole 74 for insertion of an axis bolt 76 therethrough. In addition, the distal end 72 of the coupling portion 68 has a pintle hole 78 for insertion of a pintle bolt 80 therethrough in order to form a rotatable connection to the connecting rod 20 therewith. The distance between the axis bolt 76 and the pintle bolt 80 as well as the angular orientation thereof is chosen such that the angular rotation of the coupling portion 68 causes the pintle bolt 80 to swing in an arc substantially similar to the arcuate path of the connecting rod 18 throughout the louver assembly's range of motion. The rocker arm portion 66 consists of an elongate section of material defining a proximal end 82 and a distal end 84 and is integrally connected to the proximal end 70 of the coupling portion 68 intermediate it's proximal and distal ends (82 and 84). A pair of chain holders (86*a* and 86*b*) are rotatably secured to the proximal and distal ends (82 and 84) respectively of the rocker arm portion 66 via pins (88*a* and 88*b*) that extend through holes (90*a* and 90*b*) therein. The pair of pull chain segments (64*a* and 64*b*) having a predetermined length defining proximal (92*a* and 92*b*) and distal (94*a* and 94*b*) ends, the distal ends are inserted into their respective chain holders (86*a* and 86*b*) and the proximal ends (92*a* and 92*b*) defining user control access points are allowed to dangle through holes 96 in the face plate 12. The lever bracket may be made from any material which would be able to withstand temperature variations inherent in an air duct register application as well as physical forces placed upon it in normal handling conditions. Examples of such materials include stamped sheet metal, plastic, or the like. In addition, the pull chain may be made from a section of a chain-of-beads, string, or any flexible cable that possesses sufficient tensile strength under normal handling conditions and whose length is easily adaptable to any user's reaching ability. The axis bolt 76, and pintle bolt 80, and described herein are bolts however it is well known in the art that any pin which provides sufficient structural integrity and allows the pulley to rotate upon its axis would be a valid substitute.

Figure 8:
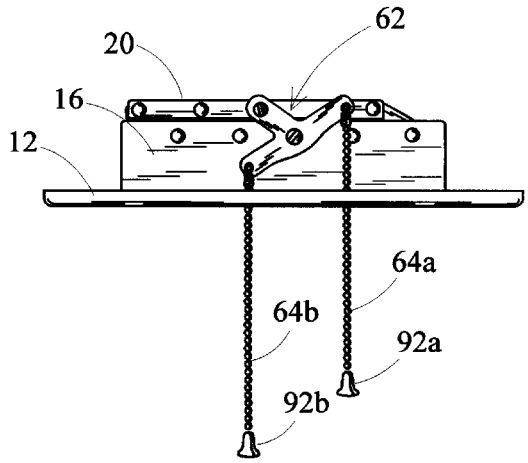
FIG. 8 is a side view of the embodiment of FIG. 7 showing the rotatable louvers in the closed position.
Figure 9:
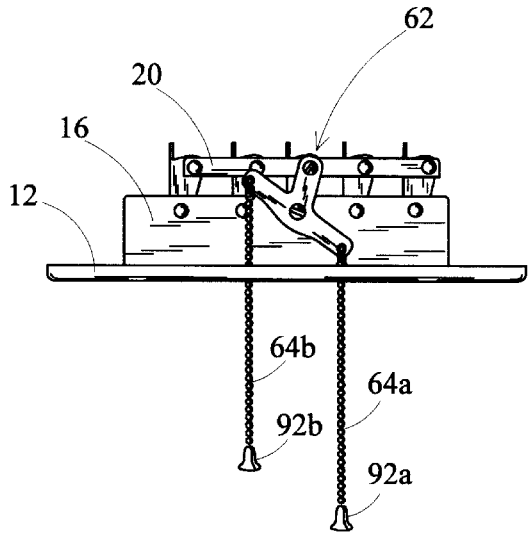
FIG. 9 is a side view of the embodiment of FIG. 7 showing the rotatable louvers in the open position.

FIGS. 8 and 9 depict the operation of the register having an ergonomically accessible airflow control mechanism. Initially in FIG. 8 the louvers are in a closed position and no airflow is allowed through the register 60. A user will pull on the first pull chain end 92*a* thus causing the lever bracket 62 to rotate in a clockwise direction. As a result, the louvers will rotate to an open position as shown in FIG. 9 and airflow is allowed to flow freely through the register. When the user desires to close the louvers again, the second pull chain end 92*b* is pulled and the louvers revert to the closed position as shown in FIG. 8. Alternatively, the user may only partially open the louvers by stopping the pulling operation when the desired orientation of the louvers has been obtained.

Figure 10:
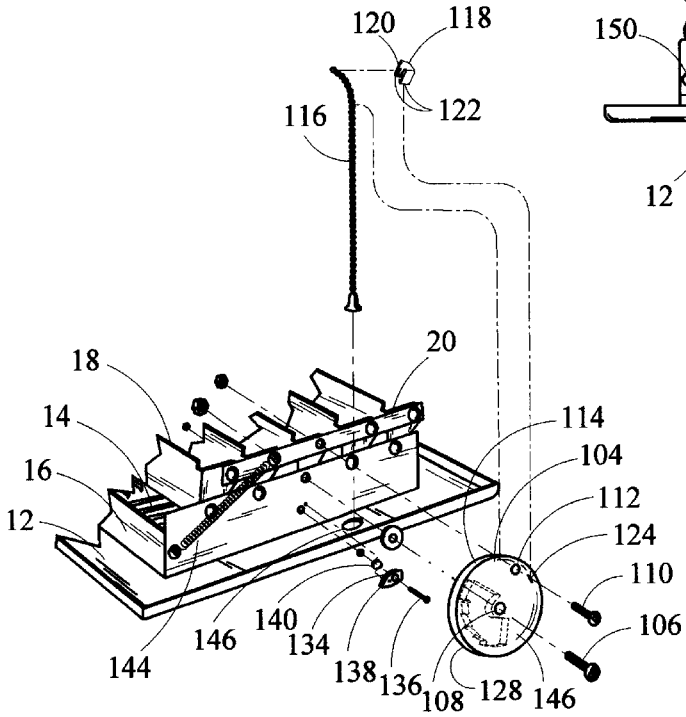
FIG. 10 is a partial perspective exploded view of an alternate embodiment of the present invention showing the ergonomically accessible airflow control mechanism as it is attached to the register.
Figure 11:
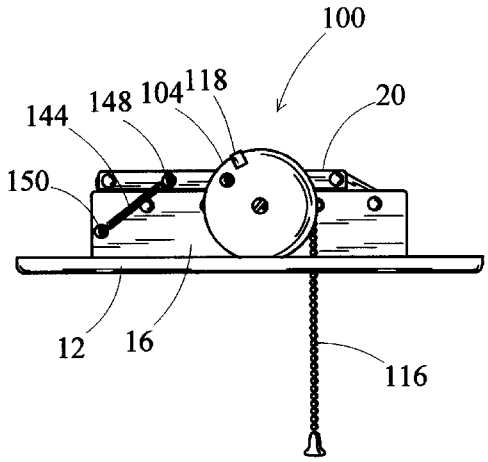
FIG. 11 is a side view of the embodiment of FIG. 10 showing the rotatable louvers in the closed position.
Figure 12:
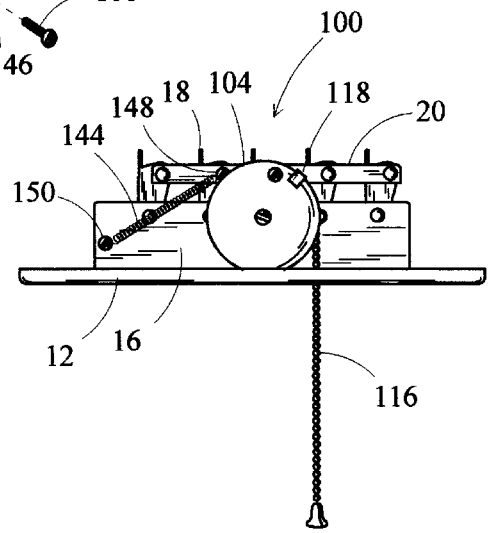
FIG. 12 is a side view of the embodiment of FIG. 10 showing the rotatable louvers in the open position.

Another alternative embodiment 100 of the present invention as shown in FIGS. 10 through 12 is a register having an ergonomically accessible airflow control mechanism which only requires one pull chain 116 to control the rotatable louvers 18 and thus the air flow through the register 100. The face plate 12, rectangular frame 16, rotatable louvers 18, and connecting rod 20 are similar in design and function to the register 10 of FIGS. 1–6. The embodiment of FIGS. 10 through 12 differ in that a tension spring 144 is provided that biases the louvers 18 to the closed position. In addition, a single pull chain segment 116 operates in conjunction with a pawl and latch portion integrally formed with a pulley 104 in order to hold the louvers 18 in a plurality of angular positions with respect to the rectangular frame 16 thereof. The plurality of angular positions of the louvers provides a controlling means for the direction and amount of airflow through the register 100.

As shown in FIG. 10, a pulley 104 the alternate embodiment of the present invention is generally circular in shape and is rotatably mounted to the rectangular frame 16 via an axis bolt 106 that extends through an axis hole 108 in the pulley 104. Also, the pulley 104 is interconnected to the connecting rod 20 via a pintle bolt 110 which extends though a pintle hole 112 formed at a predetermined distance from the pulley's axis. The distance between the axis bolt 106 and the pintle bolt 110 as well as the angular orientation thereof is chosen such that the angular rotation of the pulley 104 causes the pintle bolt to swing in an arc substantially similar to the arcuate path of the connecting rod 20 throughout the rotatable louver assembly's range of motion. The pulley 104 has a slot 114 formed around its entire periphery which is dimensioned to accept a section of pull chain 116 therein. A chain holder 118 has a snap fit for one link section of the pull chain 116 thereby providing means of transferring tensional forces of the pull chain 116 to rotational movement of the pulley 104. A chain holder 118 constructed from resilient metal or the like has a snap-in tab 120 to replaceably secure the chain thereto and two mounting tabs 122 facing inward which fit into chain holder slots 124 on the side of the pulley 104. Moreover, the chain holder 118 is replaceably secured on the pulley 104 at a position in which the pull chain will always be in contact with the pulley throughout the available rotational range of the rotatable louvers 18. In its operable orientation, the pull chain 116 is allowed to dangle from the pulley 104 and extend through a hole 146 in the face plate 12, the lowest section of the pull chain defining a user control access point.

Alternatively, a grommet (not shown) which may be constructed of hard rubber, nylon, or the like may be added to the hole 146 in order to enhance the present invention's aesthetic appeal. The pull chain may be made from a section of a chain-of-beads, string, or any flexible cable that possesses sufficient tensile strength under normal handling conditions and whose length is easily adaptable to any length. The chain holder in the aforementioned example was formed from a flat piece of resilient metal however it is well known in the art that the pull chain may be secured to the pulley using other means; an example of such including a section of wire which is bent at one end to form a loop, wherein the loop engages at least one section of the pull chain and the other end is inserted into a hole in the pulley for replaceable securement of one section of the pull chain to the pulley (not shown). The axis bolt 106, and pintle bolt 110, and described herein are bolts however it is well known in the art that any pin which provides sufficient structural integrity and allows the pulley to rotate upon its axis would be a valid substitute. The pulley in the aforementioned embodiment was made from thermoset polyurethane resin however the pulley may be made from any material which would be able to withstand temperature variations inherent in an air duct register application as well as physical forces placed upon it in normal handling conditions. Examples of such materials include nylon, plastic, pot metal, or the like.

As shown in FIGS. 13*a* through 13*d*, the pulley 104 of the alternative embodiment includes a latch portion 126 which is integrally formed in a recess on the inner side 128 thereof. The recess defining the latch portion 126 on the inner side of the pulley 104 includes a plurality of equally separated teeth (142*a*–142*d*) having a sawtooth-like configuration, an end-of-travel region 130, and a pawl reset region 132. A pawl 134 formed from high impact nylon, or the like is rotatably connected to the rectangular frame 16 with a pawl bolt 136 and is springably biased with the pawl tip 138 directed opposite the axis of the pulley 104 using coil spring 140. Thus the pawl tip is always springably biased against the teeth 128 of the latch portion 126 whether the pulley 104 is moving in a clockwise direction to open the louvers 18 or in a counter-clockwise direction to close the louvers 18.

Figure 13A:
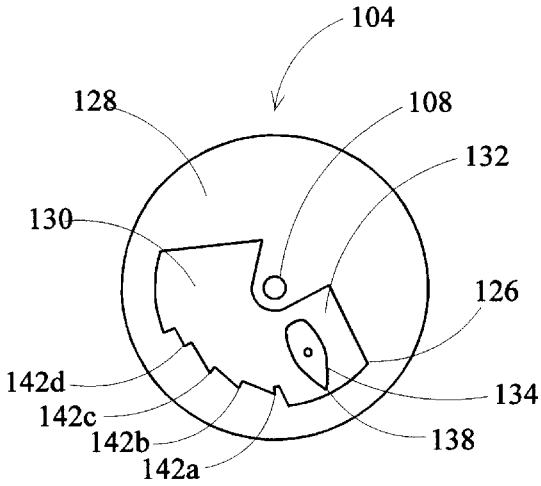
FIG. 13*a* is a plan view of the inside surface of the pulley having a latch portion in conjunction with a pawl of the embodiment of FIG. 10 showing the relative orientation of the pawl to the latch portion while the louvers are in the closed position.
Figure 13B:
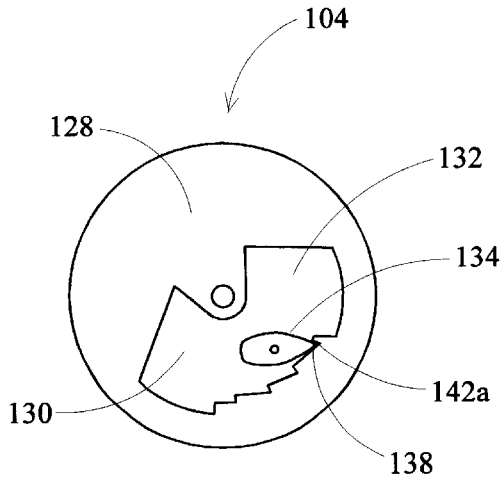
FIG. 13*b* is a plan view of the inside surface of the pulley having a latch portion in conjunction with a pawl of the embodiment of FIG. 10 showing the relative orientation of the pawl to the latch portion while the louvers are in the partially open position.
Figure 13C:
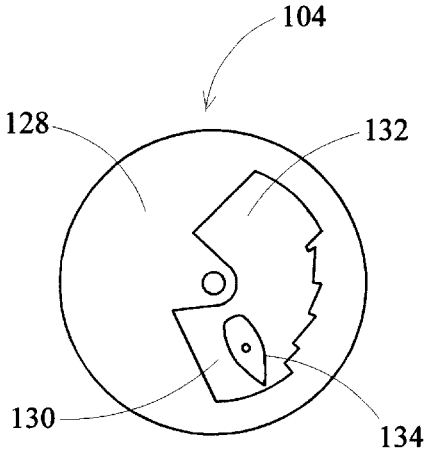
FIG. 13*c* is a plan view of the inside surface of the pulley having a latch portion in conjunction with a pawl of the embodiment of FIG. 10 showing the relative orientation of the pawl to the latch portion while the louvers have been rotated past the fully open position for release and reversal of the pawl in order to allow the louvers to rotate to the closed position upon release of the pull chain by the user.
Figure 13D:
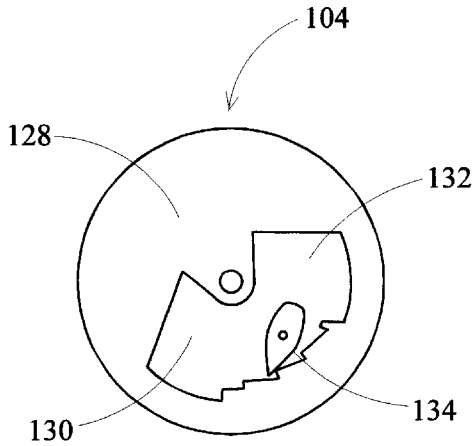
FIG. 13*d* is a plan view of the inside surface of the pulley having a latch portion in conjunction with a pawl of the embodiment of FIG. 10 showing the relative orientation of the pawl to the latch portion while the orientation of the pawl is reversed and does not engage the teeth of the latch portion and the louvers are reverting to the closed position.

In use, initially the louvers 18 are in the closed position as shown in FIG. 11 and the pawl 134 rests freely in the latch portion and thus the pawl tip 138 is directed opposite the pulley axis hole 108 as shown in FIG. 13*a*. When the user pulls on the pull chain 116, the pawl tip snaps into tooth 142*a* such that the louvers remain in a partially open position even when tension is removed from the pull chain 116. FIG. 13*b* shows the pawl tip 138 which is actively engaged in tooth 142*a* while the louvers are in a partially open position. As the pull chain 116 is continually pulled the pawl tip 138 engages with teeth 142*b*, 142*c*, and 142*d* which is the fully open position as shown in FIG. 12. Finally, when the pull chain 116 is pulled again, the pawl 134 is allowed to rotate freely in the end-of-travel region 130 as shown in FIG. 13*c*. When the pull chain 116 is subsequently released, the force of the tension spring 144 which biases the louvers to the closed position, being attached to the rectangular frame 18 and connecting rod 20 via pins (148 and 150) causes the louvers 18 to close and thus turn the pulley 104 counter-clockwise as seen from the outer surface 146 of the pulley 104. FIG. 13*d* shows the orientation of the pawl against the teeth of the latch portion 126 while the louvers 18 are reverting to the closed position. Therefore, the act of opening and closing the louvers 18 can be accomplished repeatedly in order to provide a more precise control over the airflow entering a room and thus increase the comfort level and energy saving capability afforded thereby. The aforementioned embodiment teaches an ergonomically accessible air flow control mechanism for a register in which the louvers are springably biased in the closed position and held in the open position using a pawl and latch arrangement, however it is well known in the art that a similar structure may be created in which the louvers are springably biased in the open position and are held in the closed position via a pawl and latch arrangement without departing from the spirit and scope of this invention.

The present invention may be embodied in other specific forms without departing from the spirit or scope of the invention. For example, the ergonomically accessible air flow control mechanism for a register which utilizes a pawl and latch assembly may be implemented using more or less than four teeth; any number of teeth may be used for incremental adjustment of the orientation of the louvers of a register. In fact, if incremental rotation of the louvers is not needed, only one tooth may be necessary. With this configuration, the louvers may only be in the fully open or fully closed position. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. An ergonomically accessible air flow control mechanism for a register, said register including a face plate, a rectangular frame mounted to upper surface of said face plate, a plurality of rotatable louvers rotatably connected to said rectangular frame which rotate simultaneously between an open and closed position to control the air flow through said register, said ergonomically accessible air flow control mechanism comprising:

A pull chain arrangement means providing easy user access to control of said plurality of louvers, said pull chain arrangement means having at least one user control access point disposed at a predetermined vertical distance below said face plate of said register for manipulation by said user;

A connecting rod which is rotatably connected to each of a said plurality of louvers thereby causing said plurality of louvers to rotate simultaneously with respect to each other; and, a pulley which is generally circular in shape and is rotatably connected to said rectangular frame for rotational movement thereon, said pulley is rotatably connected to said connecting rod such that rotation of said pulley causes said connecting rod to move in an arcuate path, said pulley having a slot around its periphery adapted to receive a portion of said pull chain arrangement means which includes a pull chain securement means therein to transfer tensional forces of said pull chain arrangement means to rotational movement of said plurality of louvers.

2. The ergonomically accessible air flow control mechanism of claim 1, wherein said chain securement means is a chain holder means for replaceably securing one section of said pull chain arrangement to the pulley for transferal of said tensional forces of said pull chain arrangement means to said rotational movement of said plurality of louvers.

3. The ergonomically accessible air flow control mechanism of claim 1, wherein said pull chain arrangement means is a section of chain-of-beads of predetermined length, and wherein chain securement means is further characterized in that said slot has indentations on the inner surface thereof for engagement of each bead of said section of chain-of-beads for transferal of said tensional forces of said section of chain-of-beads to said rotational movement of said plurality of louvers.

4. The ergonomically accessible air flow control mechanism of claim 1, wherein said pull chain arrangement means is a section of flexible cable of predetermined length having a proximal and distal end, said proximal and distal end of pull chain dangle from said pulley through a pair of holes in said face plate, a portion of said flexible cable contacting said pulley is intermediate said proximal and distal ends of pull chain.

5. The ergonomically accessible airflow control mechanism of claim 4, wherein said flexible cable is made of chain-of-beads.

6. The ergonomically accessible air flow control mechanism of claim 4, wherein said flexible cable is made of string.

7. A method of controlling the airflow emanating from an air duct in an easily accessible manner comprising:

providing a register adapted to be mounted to the terminating portion of an air duct generally flush with the ceiling of a room, said register including a face plate, a rectangular frame mounted to upper surface of said face plate, a plurality of rotatable louvers rotatably connected to said rectangular frame which rotate simultaneously between an open and closed position to control the air flow through said register, a pull chain arrangement means providing easy user access to control of said plurality of louvers, said pull chain arrangement means having at least one user control access point disposed at a predetermined vertical distance below said face plate of said register for manipulation by said user, a connecting rod which is rotatably connected to each of a said plurality of louvers thereby causing said plurality of louvers to rotate simultaneously with respect to each other and, a pulley which is generally circular in shape and is rotatably connected to said rectangular frame for rotational movement thereon, said pulley is rotatably connected to said connecting rod such that rotation of said pulley causes said connecting rod to move in an arcuate path, said pulley having a slot around its periphery adapted to receive a portion of said pull chain arrangement means which includes a pull chain securement means therein to transfer tensional forces of said pull chain arrangement means to rotational movement of said plurality of louvers;

mounting said register to the terminating portion of an air duct generally flush with the ceiling of a room; and pulling on said pull chain arrangement means at said user control access point in order to provide for reciprocal movement of said louvers between said open and closed position.

* * * * *